US009510415B1

(12) United States Patent
Wang

(10) Patent No.: US 9,510,415 B1
(45) Date of Patent: Nov. 29, 2016

(54) AC LED LIGHTING SYSTEMS AND CONTROL METHODS WITHOUT FLICKERING

(71) Applicant: Analog Integrations Corporation, Hsin-Chu (TW)

(72) Inventor: Jing-Chyi Wang, Hsin-Chu (TW)

(73) Assignee: Analog Integrations Corporation, Hsin-Chu (TW)

( * ) Notice: Subject to any disclaimer, the term of this patent is extended or adjusted under 35 U.S.C. 154(b) by 0 days.

(21) Appl. No.: 14/953,444

(22) Filed: Nov. 30, 2015

(51) Int. Cl.
*H05B 33/08* (2006.01)

(52) U.S. Cl.
CPC ..... *H05B 33/0845* (2013.01); *H05B 33/083* (2013.01); *H05B 33/0809* (2013.01)

(58) Field of Classification Search
CPC .... H05B 37/02; H05B 33/08; H05B 33/083; H05B 33/0815; H05B 33/0809; H05B 33/0848
USPC ..... 315/121, 185 R, 186, 200 R, 291, 294, 315/307, 308, 312
See application file for complete search history.

(56) References Cited

U.S. PATENT DOCUMENTS

| | | | | |
|---|---|---|---|---|
| 8,384,307 | B2 * | 2/2013 | Grajcar | H05B 33/083 315/185 R |
| 9,066,392 | B2 * | 6/2015 | Lee | H05B 33/0809 |
| 2011/0199003 | A1 * | 8/2011 | Muguruma | H05B 33/083 315/122 |
| 2014/0197741 | A1 * | 7/2014 | Sakai | H05B 33/0824 315/123 |
| 2015/0245427 | A1 * | 8/2015 | Jung | H05B 33/0824 315/193 |

* cited by examiner

*Primary Examiner* — Thai Pham
(74) *Attorney, Agent, or Firm* — Winston Hsu; Scott Margo

(57) ABSTRACT

A LED lighting system performs no flicking. A rectifier receives an AC input voltage to generate a rectified input voltage at an input power line and a ground voltage at a ground line. A LED string comprises LEDs connected in series to have a main anode and a main cathode. The main anode is coupled to the input power line. A power bank is connected to the input power line and the main cathode. The circuit conducts a first driving current from the main cathode to the ground line, and a second driving current from the power bank to the ground line. The second driving current increases electric energy stored in the power bank. Both the first and second driving currents flow through the LED string. The power bank releases the electric energy to make at least one of the LEDs illuminate when the AC input voltage is about 0V.

18 Claims, 6 Drawing Sheets

AC LED LIGHTING SYSTEMS AND CONTROL METHODS WITHOUT FLICKERING

BACKGROUND

The present disclosure relates generally to Light-Emitting Diode (LED) lighting systems, and more particularly to Alternating Current (AC) driven LED lighting systems and control methods the do not introduce flickering.

Light-Emitting Diodes or LEDs are increasingly being used for general lighting purposes. In one example, a set of LEDs is powered from an AC power source and the term "AC LED" is sometimes used to refer to such circuit. Concerns for AC LED lighting systems include manufacture cost, power efficiency, power factor, flicker, lifespan, etc.

FIG. 1 demonstrates AC LED lighting system 10 in the art, which, in view of electric circuit, simply has a LED module 12 and a current-limiting resistor 14. The LED module 12 consists of two LED strings connected in anti-parallel. The AC LED lighting system 10 in FIG. 1 requires neither an AC-DC converter nor a rectifier. Even though a DC voltage is also compatible, an AC voltage $V_{AC}$ is typically supplied to power the AC LED circuit 10 directly. Simplicity in structure and low-price in manufacture are two advantages the AC LED lighting system 10 provides. Nevertheless, the AC LED lighting system 10 can only emit light in a very narrow time period in each AC cycle time, suffering in low average luminance.

FIG. 2 demonstrates another AC LED lighting system 15 in the art. Examples of the AC LED lighting system 15 can be found from U.S. Pat. No. 7,708,172. The AC LED lighting system 15 employs full-wave rectifier 18 to rectify an AC voltage $V_{AC}$ and provide a DC output power source across an input power line IN and a ground line GND. A string of LEDs are segregated into LED groups $\mathbf{20}_1$, $\mathbf{20}_2$, $\mathbf{20}_3$, and $\mathbf{20}_4$, each having one or more LEDs. An integrated circuit 22 as an LED controller has pins or nodes $PIN_1$, $PIN_2$, $PIN_3$, and $PIN_4$, connected to the cathodes of LED groups $\mathbf{20}_1$, $\mathbf{20}_2$, $\mathbf{20}_3$, and $\mathbf{20}_4$ respectively. Inside integrated circuit 22 are channel switches $SG_1$, $SG_2$, $SG_3$, and $SG_4$, and a current controller 24 as well. When the rectified input voltage $V_{IN}$ at the input power line IN increases, current controller 24 can adjust the conductivity of channel switches $SG_1$, $SG_2$, $SG_3$, and $SG_4$, to make more LED groups join to emit light. Operations of integrated circuit 22 have been exemplified in U.S. Pat. No. 7,708,172 and are omitted here for brevity.

FIG. 3 illustrates the waveforms of signals in FIG. 2 when the AC input voltage $V_{AC}$ has a sinusoidal waveform. The upmost waveform in FIG. 3 shows the rectified input voltage $V_{IN}$ at the input power line IN. The second shows the total number of illuminating LEDs, meaning the number of LEDs that are illuminating. The four following waveforms regard with LED currents $I_{LED4}$, $I_{LED3}$, $I_{LED2}$ and $I_{LED1}$, which, as shown in FIG. 2, refer to the currents flowing through LED groups $\mathbf{20}_4$, $\mathbf{20}_3$, $\mathbf{20}_2$ and $\mathbf{20}_1$, respectively. The total number of illuminating LEDs rises or descends stepwise, following the increase or decrease of the rectified input voltage $V_{IN}$. When the rectified input voltage $V_{IN}$ increases, LED groups $\mathbf{20}_1$, $\mathbf{20}_2$, $\mathbf{20}_3$, and $\mathbf{20}_4$, one by one according to a forward sequence, join to illuminate. For example, when the rectified input voltage $V_{IN}$ increases to just exceed the forward voltage $V_{TH1}$, the voltage required for driving the LED group $\mathbf{20}_1$ to illuminate, the LED group $\mathbf{20}_1$ starts illuminating. When the rectified input voltage $V_{REC}$ decreases, LED groups $\mathbf{20}_1$, $\mathbf{20}_2$, $\mathbf{20}_3$, and $\mathbf{20}_4$ darken, one by one according to a backward sequence. If, for example, the rectified input voltage $V_{IN}$ just falls below the forward voltage $V_{TH4}$, the voltage required for driving all the LED groups $\mathbf{20}_1$, $\mathbf{20}_2$, $\mathbf{20}_3$ and $\mathbf{20}_4$ to illuminate, then the channel switches $SG_3$ and $SG_4$ are switched ON and the channel switches $SG_2$ and $SG_1$ are OFF, such that the LED group $\mathbf{20}_4$ stops illuminating, leaving only the LED groups $\mathbf{20}_1$, $\mathbf{20}_2$ and $\mathbf{20}_3$ to emit light. The AC LED lighting system 15 enjoys simple circuit architecture and, as can be derived, good power efficiency.

There in FIG. 3 however shows a dark period $T_{DARK}$ when no LEDs illuminate, because the rectified input voltage $V_{IN}$ is too low to drive the LED group $\mathbf{20}_1$. If the rectified voltage $V_{IN}$ is a 120-Hertz signal, the voltage valley where the rectified voltage $V_{IN}$ is about zero volt appears at 120 Hz, causing the dark period $T_{DARK}$ to show up at the same frequency of 120 Hz. This phenomenon is sometimes referred to as flickering. Even though flickering might not be perceivable by human eyes, it is reported that people watching objects exposed under the luminance of the LED lighting system 15 could feel dizzy or discomfort. It is desired to have an AC LED lighting system that produces no flickering.

BRIEF DESCRIPTION OF THE DRAWINGS

The invention can be more fully understood by the subsequent detailed description and examples with references made to the accompanying drawings, wherein.

DETAILED DESCRIPTION

The following embodiments are described in sufficient detail to enable those skilled in the art to make and use the invention. It is to be understood that other embodiments would be evident based on the present disclosure, and that improves or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known configurations and process steps are not disclosed in detail.

Figure 4:
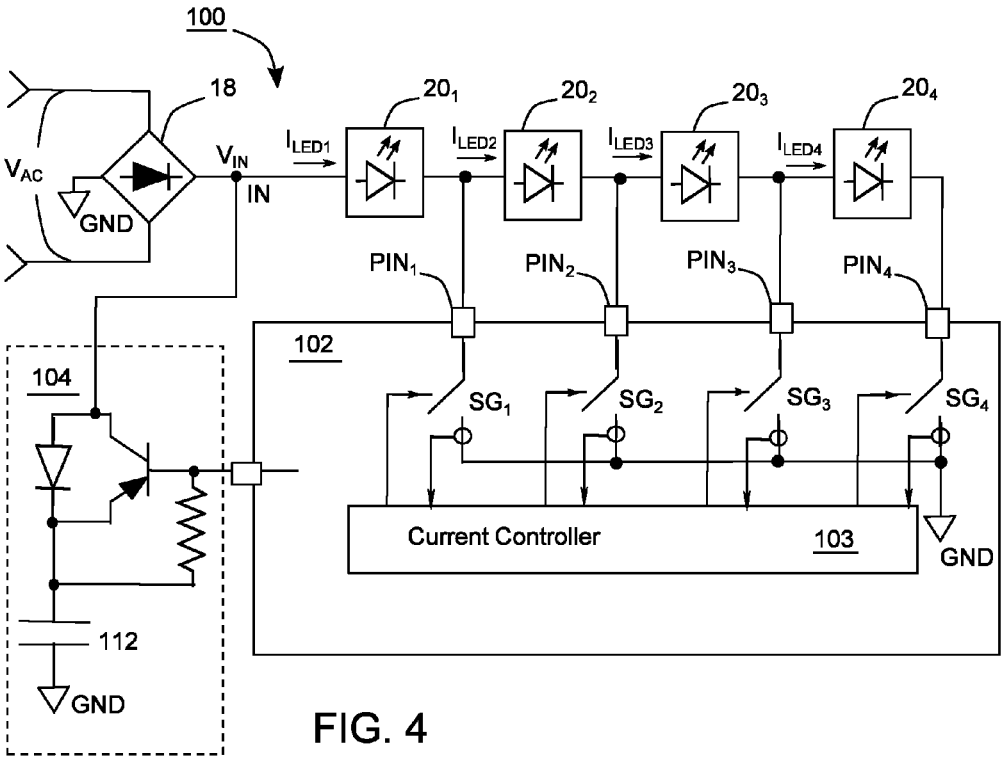
FIG. 4 demonstrates another AC LED lighting system.

FIG. 4 demonstrates an AC LED lighting system 100. The AC LED lighting system 100 has a full-wave rectifier 18 to rectify a sinusoid AC input voltage $V_{AC}$, and provides a rectified input voltage $V_{IN}$ at the input power line IN and a ground voltage at the ground line GND. The LED groups $\mathbf{20}_1$, $\mathbf{20}_2$, $\mathbf{20}_3$ and $\mathbf{20}_4$ together compose a LED string connected in series between the input power line IN and the ground line GND. This LED string is deemed to have a main anode connected to the input power line IN and a main cathode connected to pin $PIN_4$. Each LED group might have only one LED in some embodiments, or consist of several LEDs connected in parallel or in series, depending on its application. The LED group $\mathbf{20}_1$ is the most upstream LED group in FIG. 4 as its anode is connected to the highest voltage in the LED string, the rectified input voltage $V_{IN}$. Analogously, the LED group $\mathbf{20}_4$ is the most downstream LED group in FIG. 4.

An integrated circuit 102 as a LED controller has channel switches $SG_1$, $SG_2$, $SG_3$ and $SG_4$, and a current controller 103. Each of channel switches $SG_1$, $SG_2$, $SG_3$ and $SG_4$ helps connect one cathode of a corresponding LED group to the ground line GND. The current controller 103 controls the conductivity of each channel switch so as to regulate the LED current $I_{LED1}$. For example, if the rectified input voltage $V_{IN}$ is so low that the LED current $I_{LED4}$ passing through the LED group $\mathbf{20}_4$ drops to about 0 A, then the current controller 103 turns on the channel switch $SG_3$, coupling the cathode of the LED group $\mathbf{20}_3$ to the ground line GND. Meanwhile, the LED current $I_{LED3}$ is monitored by the current controller 103 to control the conductivity of the channel switch $SG_3$, so as to regulate the LED current $I_{LED1}$.

The AC LED lighting system 100 includes a power bank 104 coupled between the input power line IN and the ground line GND. The power bank 104 increases the electric energy stored in the capacitor 112 when the absolute value of the sinusoid AC voltage $V_{AC}$, $|V_{AC}|$, goes up along its way to maximums. The power bank 104 could be triggered by the integrated circuit 102 to release the electric energy, and to make the LED string illuminate when the rectified input voltage $V_{IN}$ is relatively low. With proper design, the AC LED lighting system 100 can illuminate continuously without flickering.

The capacitor 112 in the power bank 104 need sustain the high voltage at the input power line IN, however. For example, if the sinusoid AC input voltage $V_{AC}$ is 240 VAC, then the capacitor 112 must inevitably tolerate the stress of at least 240V. First of all, it is known in the art that high-voltage-tolerable devices are expensive. Second, the effective capacitance of a high-voltage-tolerable capacitor lowers when operating under a relatively-high voltage. For example, the effective capacitance of the capacitor 112 could be as large as 470 nF when the voltage stress across it is about 0V, but it becomes as low as 200 nF when the voltage stress increases to 260V. It is required to have the capacitor 112 with certain large capacitance, in order to avoid flickering. Therefore, the cost for assembling the AC LED lighting system 100 could be considerable.

Figure 5:
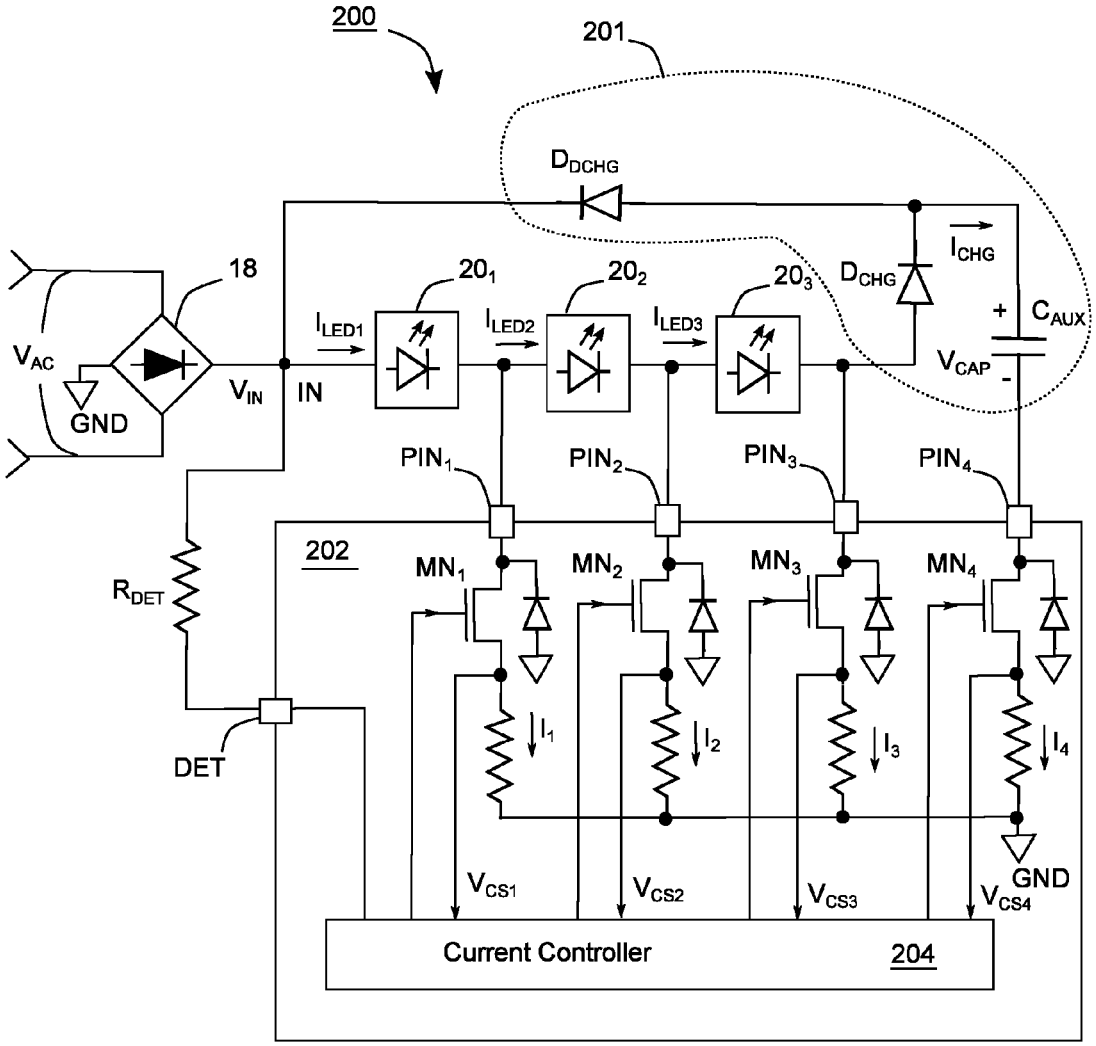
FIG. 5 demonstrates an AC LED lighting system according to embodiments of the invention.

FIG. 5 demonstrates an AC LED lighting system 200 according to embodiments of the invention. A full-wave rectifier 18 rectifies a sinusoid AC input voltage $V_{AC}$ to generate a DC input power source across an input power line IN and a ground line GND. The voltage at the input power line IN is referred to as a rectified input voltage $V_{IN}$, and the voltage at the ground line GND is deemed to be a ground voltage, or 0V. The LED string in the embodiment of FIG. 5 has three LED groups $\mathbf{20}_1$, $\mathbf{20}_2$, and $\mathbf{20}_3$, connected in series between the input power line IN and pin $PIN_3$. The LED string in FIG. 5 as a whole could act as a diode with a main anode connected to the input power line IN and a main cathode connected to pin $PIN_3$. A power bank 201 has two diodes $D_{CHG}$ and $D_{DCHG}$, and a capacitor $C_{AUX}$. As shown in FIG. 5, the diode $D_{CHG}$ and the capacitor $C_{AUX}$ is connected in series between the main cathode (pin $PIN_3$) and pin $PIN_4$, while the diode $D_{DCHG}$ is connected between the main anode (input power line IN) and the capacitor $C_{AUX}$. It will become apparent later that the diode $D_{CHG}$ is for charging the capacitor $C_{AUX}$ and the diode $D_{DCHG}$ is for discharging the capacitor $C_{AUX}$. The currents flowing through LED group $\mathbf{20}_1$, $\mathbf{20}_2$ and $\mathbf{20}_3$ are denoted as LED currents $I_{LED1}$, $I_{LED2}$ and $I_{LED3}$, respectively. The current passing through the capacitor $C_{AUX}$ to the ground line GND is denoted as a charge current $I_{CHG}$.

An integrated circuit 202 performs as a LED controller, having channel switches $MN_1$, $MN_2$, $MN_3$ and $MN_4$, and a current controller 204. Channel switches $MN_1$, $MN_2$ and $MN_3$ help connect LED group $\mathbf{20}_1$, $\mathbf{20}_2$ and $\mathbf{20}_3$ to the ground line GND, respectively, while the channel switches $MN_4$ helps connect one terminal of the capacitor $C_{AUX}$ to the ground line GND. The current passing through the channel switches $MN_1$, $MN_2$, $MN_3$, and $MN_4$ are denoted as driving currents $I_1$, $I_2$, $I_3$ and $I_4$ respectively. Similar with the function of the current controller 103 in FIG. 4, the current controller 204 in FIG. 5 controls the conductivity of each channel switch so as to control the LED current $I_{LED1}$. For example, if the current controller 204 senses that the driving currents $I_3$ and $I_4$ both drop to 0 A, then the current controller 204 turns on the channel switch $MN_2$, coupling the cathode of the LED group $\mathbf{20}_2$ to the ground line GND. The driving current $I_2$, which is substantially equal to LED current $I_{LED2}$ in amplitude in the meantime, is monitored by the current controller 204, so as to control the conductivity of the channel switch $MN_2$ and to regulate both the LED currents $I_{LED1}$ and $I_{LED2}$.

In one embodiment, the LED current $I_{LED1}$, the combination of the driving currents $I_1$, $I_2$, $I_3$ and $I_4$, is regulated to be a target value. For instance, in case that the rectified input voltage $V_{IN}$ is high enough to make all the LED groups $\mathbf{20}_1$, $\mathbf{20}_2$ and $\mathbf{20}_3$ illuminate, channel switches $MN_1$ and $MN_2$ are kept being OFF, and channel switches $MN_3$ and $MN_4$ are controlled to have the summation of driving currents $I_3$ and $I_4$ equal to the target value. In other words, the driving currents $I_1$ and $I_2$ are both 0 and the LED current $I_{LED3}$ is regulated to be the target value. A portion of the LED current $I_{LED3}$ could be diverted to become the charge current $I_{CHG}$, which, as time goes by, charges the capacitor $C_{AUX}$ and increases the electric energy stored by the capacitor $C_{AUX}$. The current controller 204 could sense the voltage $V_{CS4}$ to determine the magnitude of the driving current $I_4$, which represents the charge current $I_{CHG}$ in the present moment. The rest of the LED current $I_{LED3}$ is led to become the driving current $I_3$ and flow through the channel switch $MN_3$. As the capacitor $C_{AUX}$ is charged up over time, the driving current $I_4$ decreases due to increment of the voltage $V_{CAP}$ and the decrement of the charge current $I_{CHG}$. The reduction in the driving current $I_4$ causes the current controller 204 to increase the conductivity of the channel switch $MN_3$, so the driving current $I_3$ increases, and the LED current $I_{LED3}$, the combination of the driving current $I_3$ and the driving current $I_4$, remains to be the target value.

Figure 1:
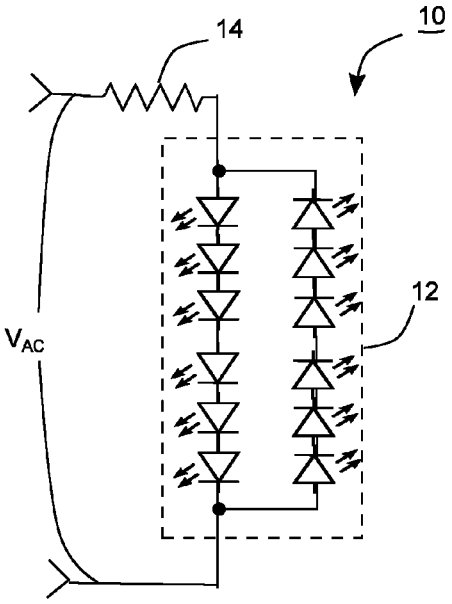
FIG. 1 (PRIOR ART)
FIGS. 1 and 2 demonstrate two AC LED lighting systems in the art.
Figure 2:
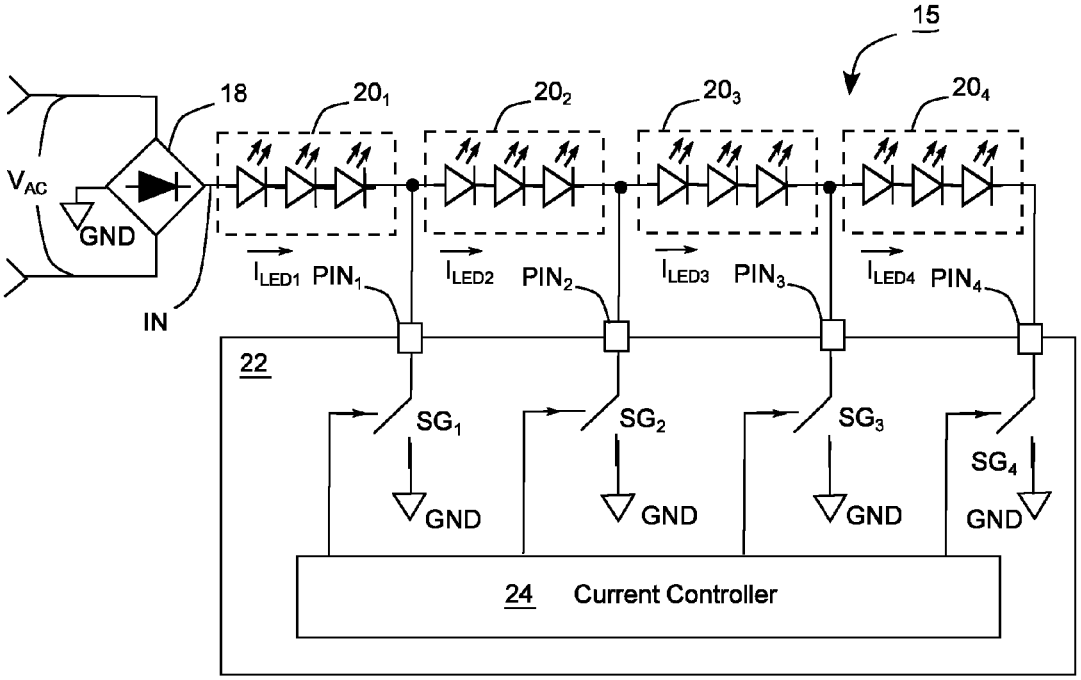
FIG. 2 (PRIOR ART)
Figure 3:
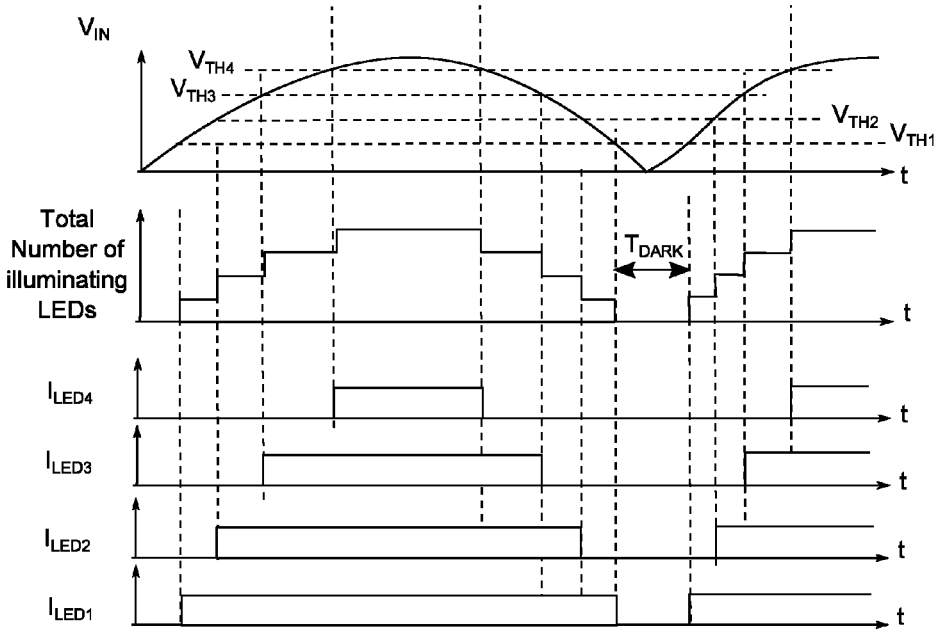
FIG. 3 (PRIOR ART)
FIG. 3 illustrates the waveforms of signals in FIG. 2.
Figure 6:
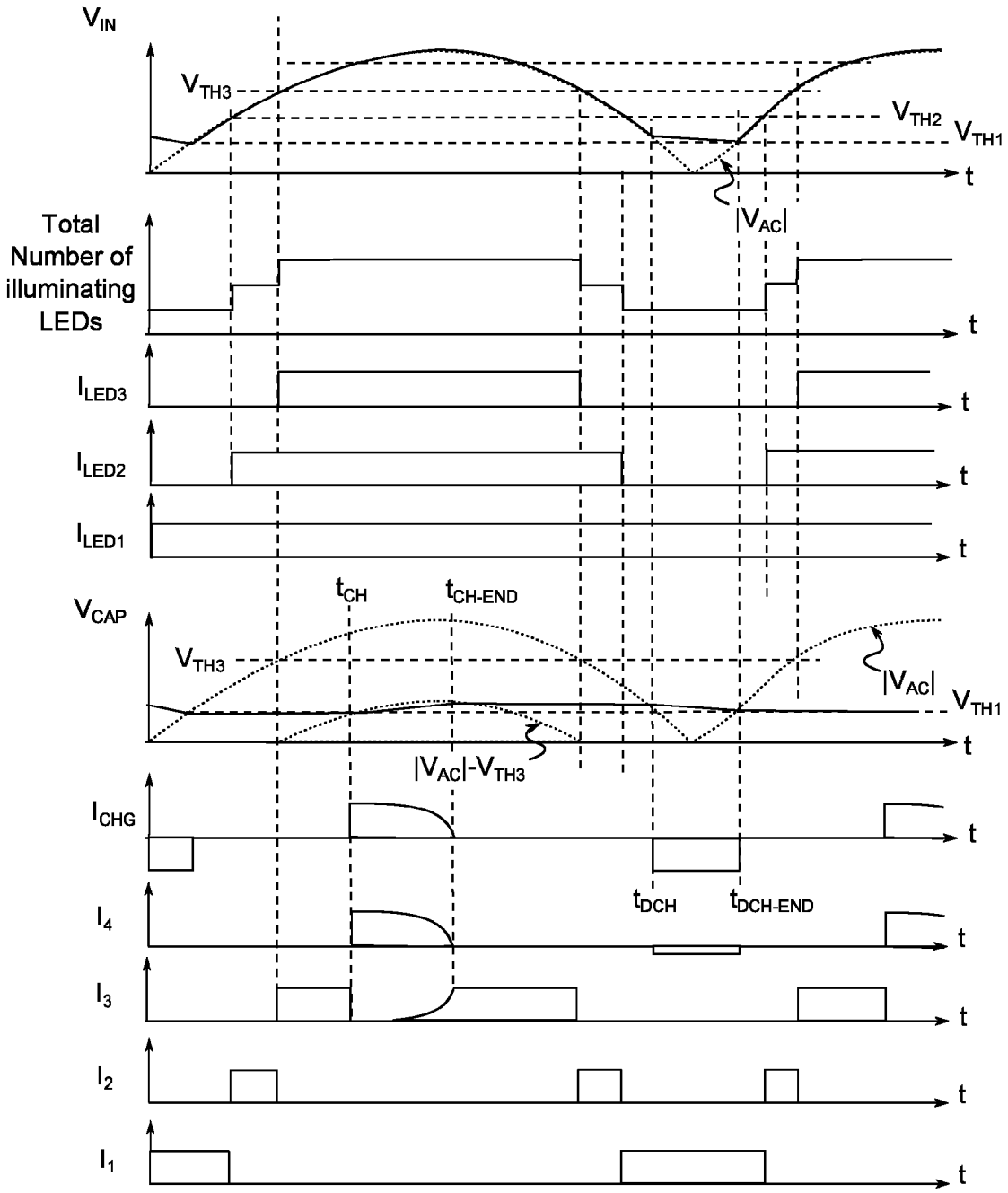
FIG. 6 shows waveforms of signals in FIG. 5.

FIG. 6 shows waveforms of signals in FIG. 5. From top to bottom, the waveforms in FIG. 6 are the rectified input voltage $V_{IN}$, the total number of illuminating LEDs, the LED currents $I_{LED3}$, $I_{LED2}$ and $I_{LED1}$, the voltage $V_{CAP}$ on the capacitor $C_{AUX}$, the charge current $I_{CHG}$, the driving currents $I_4$, $I_3$, $I_2$ and $I_1$, respectively. What is noted in FIG. 6 is that the total number of illuminating LEDs in FIG. 6 never drops to 0 all the time, implying the disappearance of the dark period $T_{DARK}$ of FIG. 3. In other words, the AC LED lighting system 200 in FIG. 5 introduces no flickering.

For comparison, the waveform of the absolute value of the AC voltage $V_{AC}$, or $|V_{AC}|$, is also plotted as a dotted curve companying the waveform of the rectified input voltage $V_{IN}$. Similarly, companying the waveform of the voltage $V_{CAP}$ are the waveforms of $|V_{AC}|$ and $(|V_{AC}|-V_{TH3})$, where the forward voltage $V_{TH3}$ is the forward voltage required for making all the LED groups $\mathbf{20}_1$, $\mathbf{20}_2$ and $\mathbf{20}_3$ illuminate. Similarly, forward voltage $V_{TH2}$ is the voltage for making at least both the LED groups $20_1$ and $20_2$ illuminate, and forward voltage $V_{TH1}$ the voltage for making the LED group $20_1$ illuminate.

Shown in FIG. 6, the LED groups $20_1$ illuminates all the time and the reason why will be detailed later. As $|V_{AC}|$ ramps upward from a voltage valley where $|V_{AC}|$ is about 0V, the LED groups $20_2$ and $20_3$ join one by one to illuminate. When $|V_{AC}|$ ramps up further and $(|V_{AC}|-V_{TH3})$ surpasses the voltage $V_{CAP}$, as what happens at the moment $t_{CH}$ in FIG. 6, the diode $D_{CHG}$ is forward biased and the charge current $I_{CHG}$ starts to charge the capacitor $C_{AUX}$ in the power bank 201. Accordingly, both the electric energy stored in the capacitor $C_{AUX}$ and the voltage $V_{CAP}$ start increasing at the moment $t_{CH}$. This charging ends when $(|V_{AC}|-V_{TH3})$ is below the voltage $V_{CAP}$, as it happens at the moment $t_{CH\text{-}END}$. Demonstrated in FIG. 6, during the charging, the charge current $I_{CHG}$ equals to the driving current $I_4$, and the LED current $I_{LED3}$, the combination of the driving currents $I_3$ and $I_4$, is regulated to be substantially constant.

The power bank 201 starts releasing the stored electric energy at moment $t_{DCH}$ when $|V_{AC}|$ drops below the voltage $V_{CAP}$ and the diode $D_{DCHG}$ becomes forward biased. Therefore, starting at moment $t_{DCH}$, the rectified input voltage $V_{IN}$ follows the voltage $V_{CAP}$, so its waveform departs from the waveform of $|V_{AC}|$, as shown in FIG. 6. The charge current $I_{CHG}$; becomes negative to discharge the capacitor $C_{AUX}$, and this negative charge current $I_{CHG}$ flows from the ground line GND, via the body diode of the channel switch $MN_4$, the capacitor $C_{AUX}$, the diode $D_{DCHG}$, and the input power line IN, to become the LED current $I_{LED1}$, which goes through the LED group $20_1$ and the channel switch $MN_1$ to be driving current $I_1$ to the ground line GND. Meanwhile, the charge current $I_{CHG}$ is about a negative constant because the driving current $I_1$ is regulated to be constant. The driving current $I_4$ or the voltage $V_{CS4}$ is slightly negative because channel switch $MN_4$ is kept ON and the voltage at pin $PIN_4$ is negative. Nevertheless, the current controller 204 could be designed to deem the negative voltage $V_{CS4}$ as 0V, and still regulate the driving current $I_1$ to be about constant while both the driving currents $I_2$ and $I_3$ are zero. The voltage $V_{CAP}$ descends as the discharging of the capacitor $C_{AUX}$ continues. As $|V_{AC}|$ bounces back from 0V and surpasses the voltage $V_{CAP}$ at moment $t_{DCH\text{-}END}$ in FIG. 6, the discharging stops and the rectified input voltage $V_{IN}$ starts following $|V_{AC}|$.

Apparent from FIG. 6, a portion of the LED current $I_{LED3}$ is diverted during the period of time from moment $t_{CH}$ to $t_{CH\text{-}END}$, to become the charge current $I_{CHG}$, which flows through the diode $D_{CHG}$ and increases the electric energy stored in the capacitor $C_{AUX}$ of the power bank 201. The electric energy stored in the capacitor $C_{AUX}$ is released via the diode $D_{DCHG}$ to make the LED group $20_1$ illuminate during the period of time from moment $t_{DCH}$ to $t_{DCH\text{-}END}$, so the AC LED lighting system 200 illuminates all the time. The period of time from moment $t_{DCH}$ to $t_{DCH\text{-}END}$ also means a period of time when the AC input voltage $V_{AC}$ is about 0.

The waveform of the voltage $V_{CAP}$ in FIG. 6 shows that the maximum voltage the capacitor $C_{AUX}$ tolerates is no more than the maximum of $(|V_{AC}|-V_{THS}|)$, which normally is only tens volts. In comparison with the capacitor 112 in FIG. 4, which need sustain a voltage as high as 240V, the capacitor $C_{AUX}$ in FIG. 6 could need to sustain only tens volt and could be a better selection in view of cost. The capacitor $C_{AUX}$ in FIG. 6 could also enjoy much higher effective capacitance in comparison with the capacitor 112 in FIG. 4.

Figure 7:
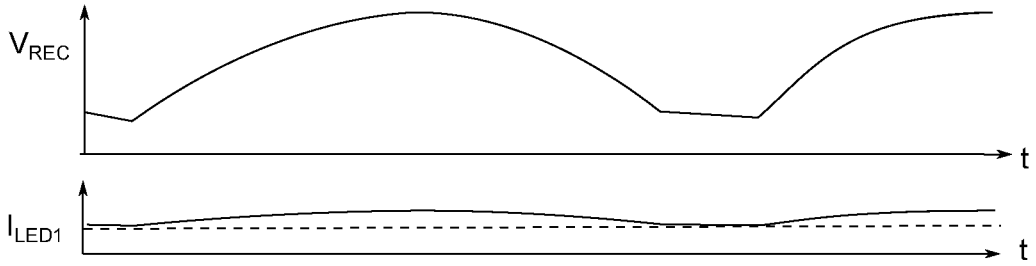
FIG. 7 shows that the LED current $I_{LED1}$ is in phase with the rectified input voltage $V_{IN}$.

As the LED current $I_{LED1}$ does not vary over time in FIG. 6, the target value that the LED current $I_{LED1}$ is regulated to be is a constant. The invention is not limited to, however. Some embodiments of the invention might have the target value varied, depending on some parameters. For example, an embodiment of the invention might change the target value when the channel switches $MN_1$, $MN_2$, $MN_3$, and $MN_4$ switch. For example, when the current controller 204 turns channel switch $MN_1$ OFF, the current controller 204 adjusts the target value, making it slightly more. In one embodiment, the more channel switches turned OFF, the higher target value. In another embodiment, the target value is in association with the rectified input voltage $V_{IN}$. The current controller 204 senses the rectified input voltage $V_{IN}$ via pin DET and resistor $R_{DET}$ in FIG. 5 to determine the target value. The higher the rectified input voltage $V_{IN}$ the more the target value, as demonstrated by FIG. 7. As the LED current $I_{LED1}$ is in phase with the rectified input voltage $V_{IN}$, which follows $|V_{AC}|$ most of the time, total harmonic distortion (THD) and power factor (PF) that AC LED lighting system 200 performs could be very excellent. An embodiment of the invention has achieved power factor of 0.97 and THD of 19%.

Figure 8:
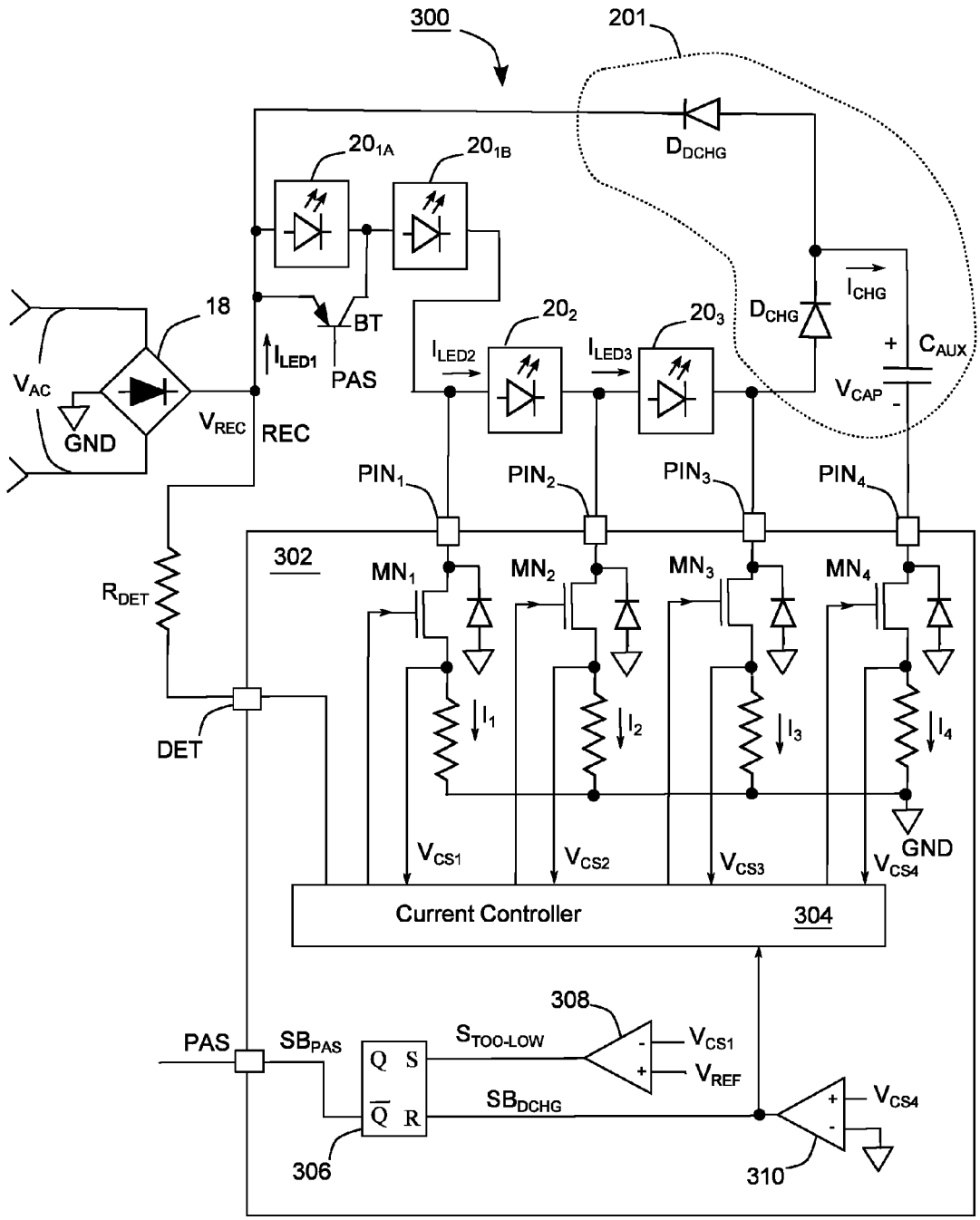
FIG. 8 demonstrates another AC LED lighting system according to embodiments of the invention.

According to embodiments of the invention, FIG. 8 demonstrates another AC LED lighting system 300, which is capable of illuminating all the time without flickering. In FIG. 8, LED groups $20_{1A}$ and $20_{1B}$ connected in series replaces LED group $20_1$ in FIG. 5. AC LED lighting system 300 further has a PNP bipolar junction transistor (BJT) BT with an emitter and a collector connected to the anode and the cathode of LED group $20_{1A}$ respectively. The base of BJT BT in FIG. 8 is connected to pin PAS of the integrated circuit 302. The BJT BT acts as a bypass switch capable of letting the LED current $I_{LED1}$ bypass the LED group $20_{1A}$. Beside the devices commonly shown in FIG. 5, the integrated circuit 302, as a LED controller, further has a current controller 304, two comparators 308 and 310, and a SR register 306. The current controller 304 in FIG. 8 is similar with the current controller 203 in FIG. 5, modifying the conductivities of channel switches $MN_1$, $MN_2$, $MN_3$ and $MN_4$ in view of the driving currents $I_1$, $I_2$, $I_3$ and $I_4$.

Comparator 310 compares the voltage $V_{CS4}$ with 0V, where the voltage $V_{CS4}$ somehow represents the driving current $I_4$ passing through channel switch $MN_4$. Please have a look of FIG. 6, where the driving current $I_4$ becomes negative only when the capacitor $C_{AUX}$ is discharging. Therefore, comparator 310 determines whether the capacitor $C_{AUX}$ is discharging.

Comparator 308 compares the voltage $V_{CS1}$ with a reference voltage $V_{REF}$, where the voltage $V_{CS1}$ represents the driving current $I_1$ passing through channel switch $MN_1$. In other words, comparator 308 determines whether the driving current $I_1$ is below a predetermined value, which in one embodiment of this invention is less than the target value that the LED current $I_{LED1}$ is regulated to.

During the time when the capacitor $C_{AUX}$ is not discharging, the voltage $V_{CS4}$ is not negative, so signal $SB_{DCHG}$ is logic 1 and SR register 306 is reset, having output signal $SB_{PAS}$ with logic 1. According, PNP BJT BT is turned OFF, so LED current $I_{LED1}$, if any, flows through both LED groups $20_{1A}$ and $20_{1B}$.

Signal $SB_{DCHG}$ turns to be logic "0" when the capacitor $C_{AUX}$ discharges to make LED groups $20_{1A}$ and $20_{1B}$ illuminate. The capacitor voltage $V_{CAP}$ of the capacitor $C_{AUX}$ descends over time during the discharging. In the meantime, the current controller 304 adjusts the conductivity of the channel switch $MN_1$ so as to regulate the driving current $I_1$ to the target value. Once the capacitor voltage $V_{CAP}$ drops below the forward voltage required for driving both LED groups $20_{1A}$ and $20_{1B}$, the driving current $I_1$ cannot be regulated any more, and starts falling. When the driving current $I_1$ drops further below the predetermined value represented by the reference voltage $V_{REF}$, comparator 308 turns signal $S_{TOO\text{-}LOW}$ into logic "1", setting the SR register 306, so signal $SB_{PAS}$ becomes logic "0" and PNP BJT BT is turned ON. LED current $I_{LED1}$, if any, then bypasses LED $20_{1A}$ and flows through LED group $20_{1B}$, to become the driving current $I_1$, which can be regulated now because the capacitor voltage $V_{CAP}$ still exceeds the forward voltage for driving only the LED group $20_{1B}$. The capacitor voltage $V_{CAP}$ can discharge further to make LED group $20_{1B}$ illuminate while the LED group $20_{1A}$ stops illuminating.

It is derivable that the capacitor $C_{AUX}$ in FIG. 8 can release its own electric energy until the capacitor voltage $V_{CAP}$ drops as low as the forward voltage required for driving only LED group $20_{1B}$. The capacitor $C_{AUX}$ in FIG. 5, however, stops discharging once the capacitor voltage $V_{CAP}$ drops below the forward voltage required for driving only LED group $20_1$. If the LED group $20_1$ in FIG. 5 consists of LED groups $20_{1A}$ and $20_{1B}$ in FIG. 8, the capacitor $C_{AUX}$ in FIG. 8 could release more electric power and operate more efficiently than the capacitor $C_{AUX}$ in FIG. 5 does.

FIG. 8 has PNP BJT BT capable of acting as a shunt to LED group $20_{1A}$, but the invention is not limited to. Another embodiment of the invention could relocate PNP BJT BT of FIG. 8 to become a shunt to LED group $20_{1B}$ instead of LED group $20_{1A}$.

The current controller 304 regulates the LED current $I_{LED1}$ to be a target value. As demonstrated previously by another embodiment, this target value could be a constant, or is determined according to some parameters. For example, this target value is set to be about a constant if signal $SB_{DCHG}$ is "1" in logic, and becomes a relatively-less constant if signal $SB_{DCHG}$ is "0" in logic. A less target value when signal $SB_{DCHG}$ is "0" is beneficial in improving THD because the signal $SB_{DCHG}$ in "0" is also an indication that the AC input voltage $V_{AC}$ is about 0V.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A LED lighting system, comprising:

a rectifier for receiving an AC input voltage to generate a rectified input voltage at an input power line and a ground voltage at a ground line;

a LED string, comprising LEDs connected in series to have a main anode and a main cathode, wherein the main anode is coupled to the input power line;

a power bank connected to the input power line and the main cathode, for storing electric energy; and a LED controller coupled to the LED string and the power bank, for conducting a first driving current from the main cathode to the ground line and for conducting a second driving current from the power bank to the ground line, wherein the second driving current increases the electric energy, and a combination of the first and second driving currents flows through the LED string;

wherein the power bank releases the electric energy via the input power line to make at least one of the LEDs illuminate when the AC input voltage is about 0V.

2. The LED lighting system of claim 1, wherein the LED controller comprises:

a first channel switch coupled between the main cathode and the ground line, for conducting the first driving current;

a second channel switch coupled between the power bank and the ground line, for conducting the second driving current through the power bank so as to store electric energy in the power bank.

3. The LED lighting system of claim 2, wherein the LED controller comprises a current controller coupled to the first and second channel switches, for regulating a summation of the first and second driving currents substantially to a target value.

4. The LED lighting system of claim 1, wherein the power bank comprises:

first and second diodes; and a capacitor for storing the electric energy;

wherein the power bank is configured to have the second driving current flow through both the first diode and the capacitor, and the electric energy is released via the second diode.

5. The LED lighting system of claim 4, wherein the first diode is connected between the capacitor and the main cathode.

6. The LED lighting system of claim 4, wherein the second diode is connected between the capacitor and the input power line.

7. The LED lighting system of claim 1, wherein the LEDs are segregated to have first and second LED groups connected via a joint in series between the main cathode and the main anode, the circuit comprises a channel switch coupled between the joint and the ground line for conducting a third driving current, and the circuit comprises a current controller regulating a summation of the first, second and third driving currents substantially to a target value.

8. The LED lighting system of claim 7, wherein the current controller senses the rectified input voltage for determining the target value.

9. The LED lighting system of claim 1, wherein the LED controller comprises:

a comparator for determining whether the electric energy is being released so as to provide a signal;

wherein the circuit regulates a LED current passing through at least one of the LEDs to a target value, and the target value depends on the signal.

10. The LED lighting system of claim 1, wherein the LEDs are segregated to have first and second LED groups connected via a joint in series between the main cathode and the main anode, and the LED lighting system comprises:

a bypass switch coupled between the input power line and the joint;

a first comparator for determining whether the electric energy is being released; and a second comparator for determining whether a driving current through the second LED group is below a reference;

wherein when the driving current is below the reference and the power bank is releasing the electric energy, the LED controller turns on the bypass switch so that the driving current bypasses the first LED group and flows through the second LED group.

11. A control method suitable for a LED lighting system to avoid flickering, wherein the LED lighting system comprises:

a rectifier for receiving an AC input voltage to generate a rectified input voltage at an input power line and a ground voltage at a ground line;

a LED string, comprising LEDs connected in series to have a main anode and a main cathode, wherein the main anode is coupled to the input power line; and an power bank connected to the main cathode, for storing electric energy;

the control method comprising:

regulating a LED current flowing through the LED string;

diverting, while the LED current is regulated at the same time, a portion of the LED current to the power bank, so as to increase the electric energy; and releasing the electric energy to make at least one of the LEDs illuminate when an AC voltage of the AC input power source is zero, thereby the LED lighting system emitting light continuously.

12. The control method of claim 11, wherein the step of regulating the LED current is to regulate the LED current to a target value, and the control method further comprises:

sensing a line voltage at the input power line to determine the target value.

13. The control method of claim 12, wherein the higher line voltage the higher target value.

14. The control method of claim 11, wherein the power bank comprises:

first and second diodes; and a capacitor for storing the electric energy;

wherein the first diode is connected between the capacitor and the main cathode; and the second diode is connected between the capacitor and the main anode.

15. The control method of claim 14, wherein:

the step of diverting is to divert the portion of the LED current to go through the first diode; and the step of releasing is to release the electric energy via the second diode.

16. The control method of claim 11, wherein the LEDs are segregated to have first and second LED groups connected via a joint in series between the main anode and the main cathode, and the method comprises:

regulating a first LED current flowing through the first LED group to a target value while a second LED current flowing through the second LED group is about zero.

17. The control method of claim 16, wherein the control method further comprises:

determining whether the electric energy is being released;

setting the target value to be a first value when the electric energy is being released; and setting the target value to be a second value different from the first value when the electric energy is not being released.

18. The control method of claim 11, comprising:

segregating the LEDs to have first and second LED groups connected in series;

releasing the electric energy to make both the first and second LED groups illuminate;

determining whether the electric energy is being released;

determining whether the LED current is regulated; and releasing the electric energy to make the second LED group but not the first LED group illuminate if the LED current is not regulated.

* * * * *